US008142048B2

(12) United States Patent
Risley, Sr.

(10) Patent No.: US 8,142,048 B2
(45) Date of Patent: Mar. 27, 2012

(54) LIGHTING ASSEMBLY HAVING END WALL WITH RETAINING MEMBER

(75) Inventor: James A. Risley, Sr., Bristol, PA (US)

(73) Assignee: Hubbell Incorporated, Shelton, CT (US)

( * ) Notice: Subject to any disclaimer, the term of this patent is extended or adjusted under 35 U.S.C. 154(b) by 378 days.

(21) Appl. No.: 12/325,596

(22) Filed: Dec. 1, 2008

(65) Prior Publication Data

US 2010/0135029 A1 Jun. 3, 2010

(51) Int. Cl.
*F21V 17/10* (2006.01)
*F21V 15/01* (2006.01)

(52) U.S. Cl. ..... 362/217.1; 362/374; 362/217.01; 362/217.05

(58) Field of Classification Search ..... 362/217.01, 362/217.05, 217.11, 217.13, 362, 374, 375, 362/147, 217.1
See application file for complete search history.

(56) References Cited

U.S. PATENT DOCUMENTS

| | | | | |
|---|---|---|---|---|
| 2,647,984 | A | 8/1953 | Flage | |
| 2,960,361 | A | 11/1960 | Boutelle | |
| 2,983,535 | A | 5/1961 | Henning | |
| 3,248,535 | A * | 4/1966 | Docimo et al. | 362/364 |
| 3,302,019 | A | 1/1967 | Menzin | |
| 4,200,905 | A | 4/1980 | Shelby et al. | |
| 4,489,367 | A | 12/1984 | Herron | |
| 4,626,969 | A * | 12/1986 | Kristofek | 362/147 |
| 6,079,851 | A * | 6/2000 | Altman et al. | 362/260 |
| 6,231,404 | B1 | 5/2001 | Lichy | |
| 6,293,510 | B1 | 9/2001 | Bradford et al. | |
| 6,378,173 | B1 | 4/2002 | Ho et al. | |
| 6,733,158 | B2 | 5/2004 | Fischer et al. | |
| 7,607,795 | B2 * | 10/2009 | Engel | 362/147 |
| 7,753,551 | B2 * | 7/2010 | Yaphe et al. | 362/147 |
| 7,914,171 | B2 * | 3/2011 | Fabbri et al. | 362/218 |
| 2005/0083688 | A1 * | 4/2005 | Dicken et al. | 362/235 |

FOREIGN PATENT DOCUMENTS

EP 0116909 8/1984

* cited by examiner

*Primary Examiner* — Peggy A. Neils
(74) *Attorney, Agent, or Firm* — Garrett V. Davis; Mark S. Bicks; Alfred N. Goodman

(57) ABSTRACT

A lighting assembly includes a housing enclosing a lamp for illuminating a target area. The housing has an open end and an end wall removably coupled to the open end of the housing. A retaining member such as a spring clip extends between the end wall and the internal portion of the housing for retaining the end wall to the housing. The spring clip has one end coupled to the end wall and a hook-like portion received in an aperture in the housing for applying a biasing tension on the end wall.

25 Claims, 5 Drawing Sheets

LIGHTING ASSEMBLY HAVING END WALL WITH RETAINING MEMBER

FIELD OF THE INVENTION

The present invention is directed to a lighting assembly having a housing with an end wall coupled to the housing by a retaining member. The invention is particularly directed to a lighting assembly having a spring clip to couple the end wall to the housing of the lighting assembly.

BACKGROUND OF THE INVENTION

Luminaire and lighting assemblies are generally designed to provide a predetermined light pattern directed to an area to be illuminated. Luminaires generally include a ballast housing for supporting the electrical hardware for operating the luminaire and the light source. The luminaire can include a lamp socket for receiving a lamp and a reflector for directing the light from the light source to the desired area. A lens or diffuser is often mounted on the assembly to enclose the light source and to soften the glare of the lamp.

Luminaires and light assemblies are generally mounted to a ceiling or ceiling support or by mounting to a pole or other support. The luminaires generally are manufactured and shipped preassembled ready for installation. The assembled luminaires are generally not readily disassembled, which can make replacement of parts difficult in some situations.

Luminaires generally have a housing that can be formed as a one-piece unit or as various panels that are coupled together. The panels are often welded or crimped together to form a one-piece unit. The various panels can also be attached by screws or other fasteners depending on the design of the luminaire.

Lighting assemblies typically include removable parts to enable replacement of the lamp and repair of the assembly. The lens or diffuser of the lighting assembly is often removable to allow access to the lamp. Springs are often used for attaching the lens to the lighting assembly, which secure the lens in place during use while allowing relative ease for the removal of the lens. One example is disclosed in U.S. Pat. No. 2,647,984 to Falge which discloses a spring having legs that are coupled to the housing and having an end which hooks onto the lens of the lamp.

Springs are also used to attach the lens to the housing of a lighting assembly where the lens is suspended by the spring. The spring can be received in a slot which captures the spring and allows the spring and the lens to be pulled away from the housing to allow access to the lamp. Examples of this type of construction are disclosed in U.S. Pat. No. 2,960,361 to Boutelle, U.S. Pat. No. 2,983,535 to Henning, U.S. Pat. No. 3,302,019 to Menzin, and U.S. Pat. No. 6,733,158 to Fischer et al.

While the prior lighting assemblies are generally suitable for their intended use, there is a continuing need in the industry for improved methods of constructing lighting assemblies and its components.

SUMMARY OF THE INVENTION

The present invention is directed to a lighting assembly having a housing for supporting a lamp. The invention is particularly directed to a lighting assembly having a housing with an end wall that is simple to construct and assemble.

One aspect of the invention is to provide a lighting assembly having a housing with opposing side walls and a bottom wall with an open top end. An optional lens or diffuser can be connected to the open top end. An end wall is attached to open ends of the housing by a latch.

The lighting assembly of the invention includes a housing with a longitudinal dimension and at least one open longitudinal end. An end wall is connected to the open longitudinal end of the housing. The housing typically contains a reflector and electrical components such as a ballast for operating a lamp. A lamp base is provided in the housing for supporting the lamp.

One aspect of the invention is to provide a light assembly having a housing with a longitudinal open end and an end wall coupled to the open longitudinal end and retained by a retaining member. The retaining member is typically a clip formed of spring steel which forms a latch. The retaining member has one end coupled to the end wall and an opposite end coupled to the housing for retaining the end wall in position.

Another aspect of the invention is to provide a lighting assembly with a housing having an end wall that is coupled to the housing by a spring latch that is easy to assemble and disassemble as needed for servicing the electrical components of the lighting assembly. In one embodiment, the spring can be connected and disconnected manually from the reflector to retain the end wall in position. The end wall is securely connected to the housing without the need for screws or adhesives.

The various aspects of the invention are basically attained by providing a housing having a first and a second opposing side wall, a bottom surface and an open longitudinal end. An end wall is removably coupled to the open end of the housing. A lamp base for supporting a lamp is positioned within the housing. A spring clip extends between the end wall and the housing for removably coupling the end wall to the housing.

The aspects of the invention are further attained by providing a lighting assembly comprising a housing having a bottom wall, and a first and a second opposing side wall where the housing has an open longitudinal end. A reflector is positioned in the housing where the reflector has an aperture. A lamp base for supporting a lamp is positioned within the housing. An end wall is removably coupled to the longitudinal end by a spring clip having a first end coupled to the end wall and a second end having a hook projection received in the aperture in the reflector.

The various aspects of the invention are also attained by providing a lighting assembly comprising a housing having a bottom wall, a first side wall with an inwardly extending rib, a second opposite side wall with an inwardly extending rib, and an open longitudinal end. A reflector is positioned in the housing and coupled to the first and second side walls. The reflector has at least one aperture therein. A lamp base is coupled to the reflector for supporting a lamp. At least one end wall is coupled to the open longitudinal end where the end wall has a bottom edge, a first side edge having a leg extending perpendicular to the end wall, and a second opposite side edge having a second leg extending perpendicular to the end wall. A spring clip has a first and a second spaced apart leg coupled to the first and second legs, respectively, of the end wall and has a body portion with a spring hook member received in the aperture in the reflector for coupling the end wall to the housing.

These and other aspects of the invention will become apparent from the following detailed description of the invention which, in conjunction with the annexed drawings, disclose various embodiments of the invention.

BRIEF DESCRIPTION OF THE DRAWINGS

The following is a brief description of the drawings, in which.

DETAILED DESCRIPTION OF THE INVENTION

Figure 1:
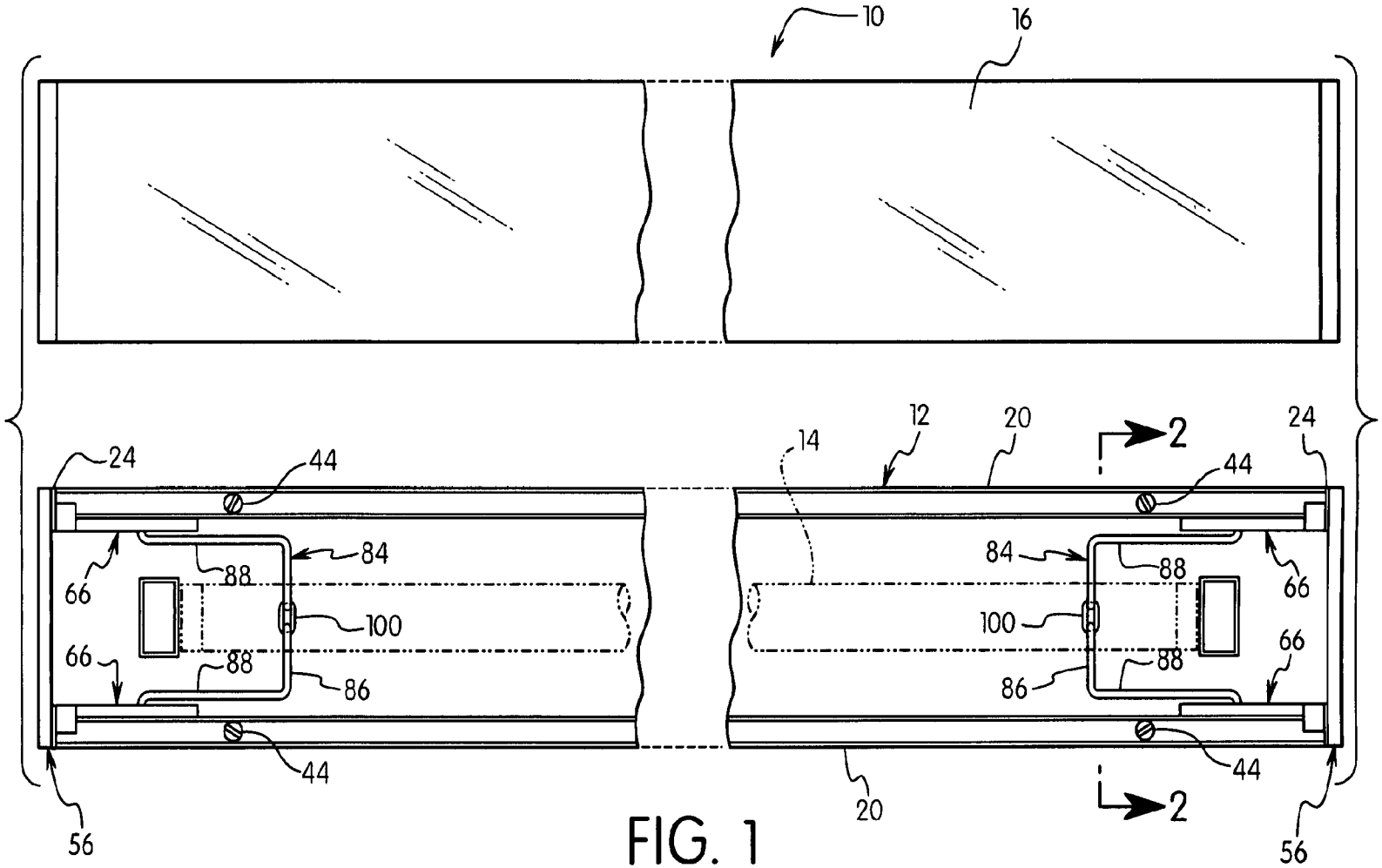
FIG. 1 is an exploded top view of the lighting assembly in one embodiment of the invention showing the housing and the lens.

The present invention is directed to a lighting assembly that can be easily assembled and disassembled for repair or replacement of the electronic components. The invention is also directed to a lighting assembly that can be easily assembled without the use of tools, screws or adhesives.

Referring to the drawings, the lighting assembly 10 of the invention includes a housing 12 for enclosing a lamp 14. A lens 16 or diffuser can be coupled to housing 12. Lens 16 is optional such that lighting assembly 10 can be used alone without a lens or diffuser. Lens 16 is constructed from the transparent or translucent material as known in the art.

Figure 2:
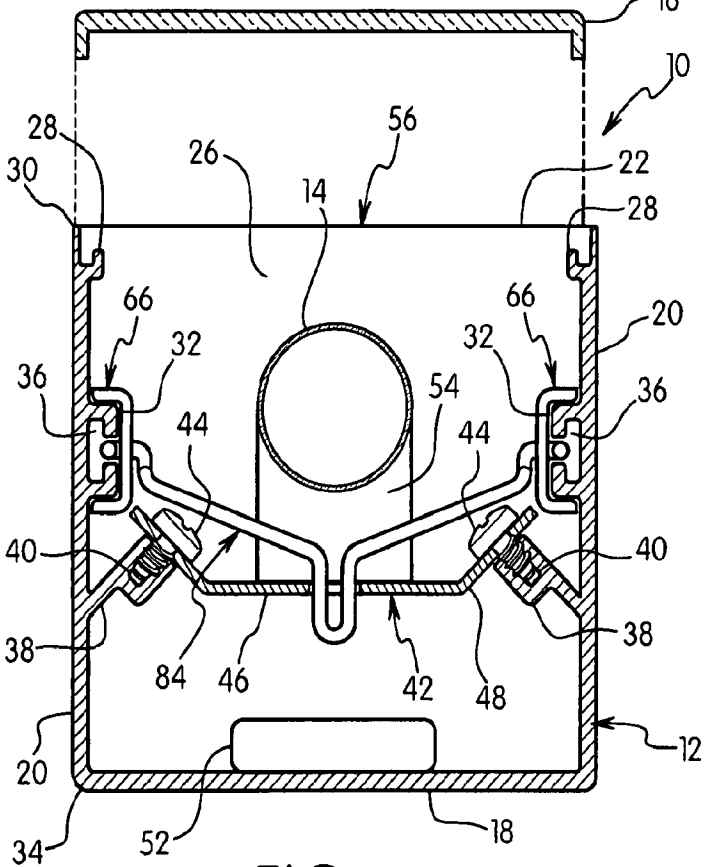
FIG. 2 is a cross-sectional end view of the housing taken along line 2-2 of FIG. 1.
Figure 5:
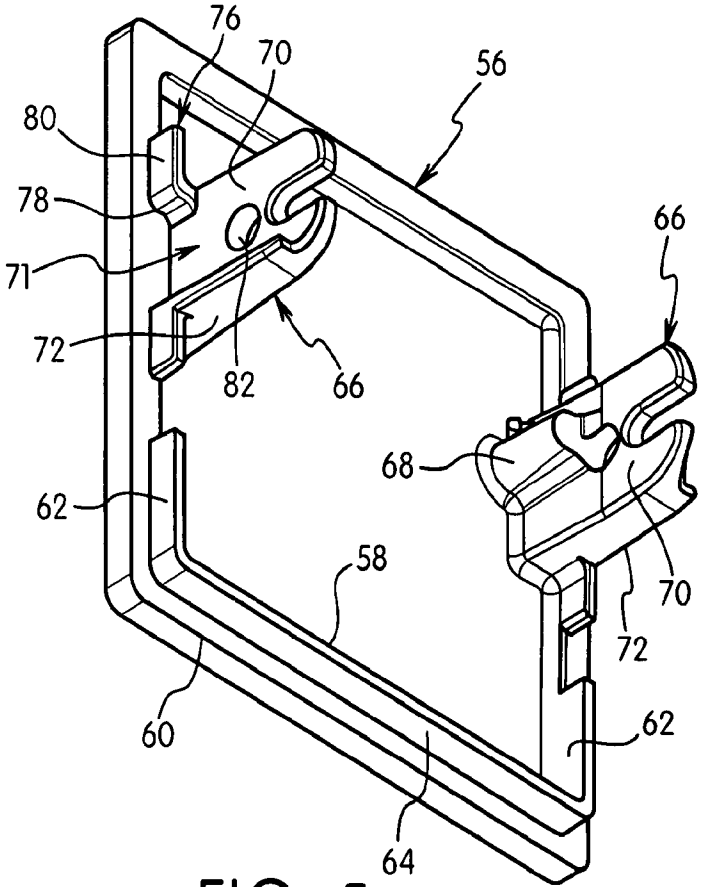
FIG. 5 is a bottom perspective view of the end wall.

Referring to FIGS. 1 and 2, housing 12 in the embodiment illustrated has a longitudinal dimension and a substantially square cross-section. Housing 12 can be any desired length and width as needed to accommodate one or more lamps depending on the lighting environment. In the embodiment illustrated, lighting assembly 10 includes a single lamp 14 for purposes of illustration, although it will be understood that a plurality of lamps can be provided. The length of housing 12 typically corresponds substantially to the length of the lamps. The width of housing 12 generally corresponds to the width of the lamps and lamp base and the number of lamps mounted in the housing.

Figure 3:
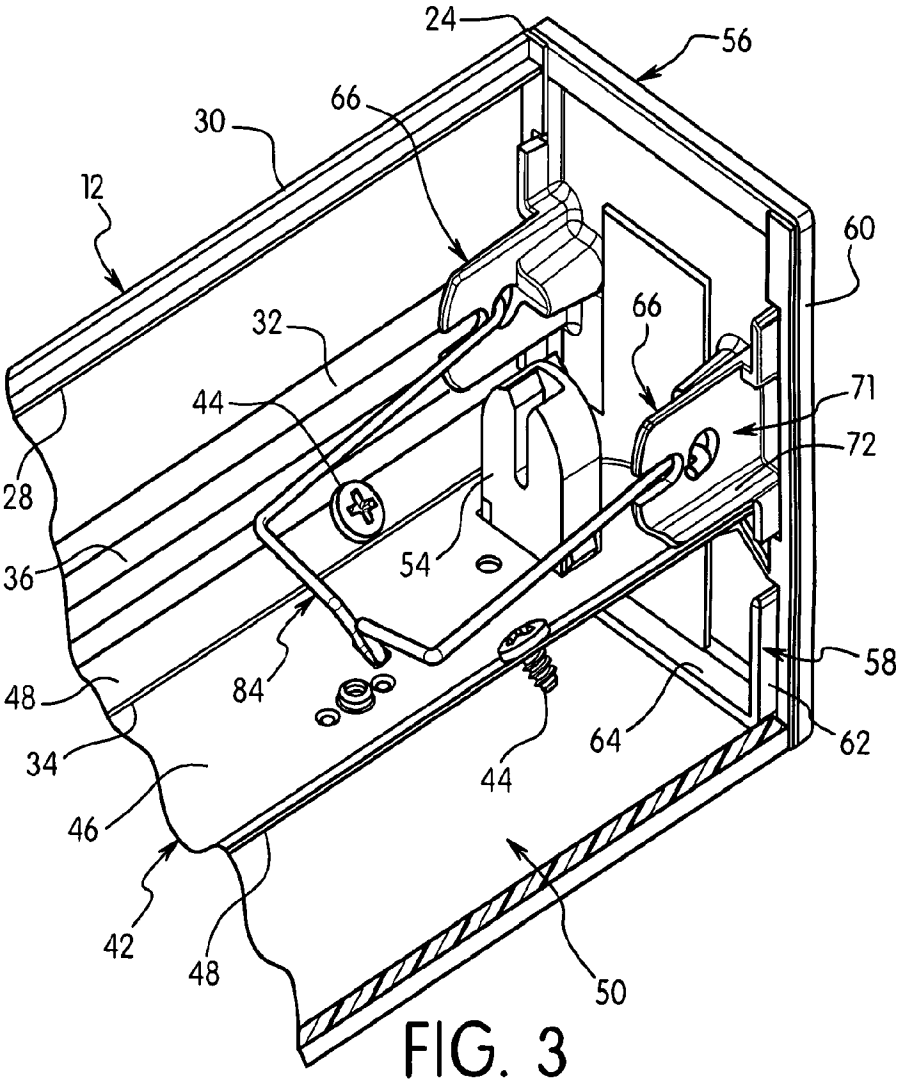
FIG. 3 is a partial perspective view shown in partial cross-section showing the retaining member for assembling the lighting assembly.

Housing 12 has a bottom wall 18 and opposite side walls 20 forming an open top end 22 and open longitudinal ends 24. In the embodiment shown, side walls 20 extend substantially perpendicular from bottom wall 18 and define an internal cavity 26 of housing 12. The inner surface of each side wall 20 includes an upper rib 28 closely spaced to a top edge 30. Rib 28 preferably extends the length of each side wall 20 and has a dimension to support lens 16. A central rib 32 extends the longitudinal length of side wall 20 and is spaced between top edge 30 and bottom edge 34. Rib 32 extends inwardly into cavity 26 as shown in FIGS. 2 and 3. In the embodiment illustrated, rib 32 includes a longitudinal T-shaped slot 36.

Housing 12 is preferably formed as a one-piece integrally formed unit. Housing 12 can be made of plastic, metal or other material and is generally formed by extrusion molding such that the extrusion molded article can be cut to length corresponding to the desired length of the lighting assembly.

Referring to FIG. 2, side walls 20 of housing 12 include a flange 38 extending the longitudinal length of housing 20. Flange 38 is positioned below rib 32 and extends in an upwardly inclined direction toward the open top end 22. Flange 32 includes a plurality of spaced apart screw holes 40. In the embodiment illustrated, flanges 38 extend from side walls 20 at an angle of about 45°.

Lighting assembly 10 includes a reflector 42 mounted within housing 12. In the embodiment illustrated, reflector 42 is attached to the respective flanges 38 by a screw 44 that extend through corresponding screw holes in reflector 42 and are threaded into screw holes 40 of flange 38. Reflector 42 can have any desired shape as needed according to the requirements for the lighting assembly. In the embodiment illustrated, reflector 42 has a substantially concave upper surface with a flat bottom wall 46, and inclined side walls 48 as shown in FIGS. 2 and 3. Screws 44 extend through screw holes in inclined side walls 48 and are threaded into screw holes 40 of flange 38 to secure reflector 42 to housing 12. Preferably, bottom wall 46 of reflector 42 is spaced from bottom wall 18 of housing 12 to define a cavity 50 for enclosing electrical components such as a ballast 52 and other electrical components and wiring.

As shown in FIG. 3, a lamp base 54 is mounted on reflector 42. Lamp base 54 as shown is a conventional fluorescent lamp base for receiving a fluorescent bulb 14 shown in FIGS. 1 and 2. In the embodiment illustrated, a single lamp base is attached to reflector 42. In alternative embodiments, a plurality of lamp bases and corresponding lamps can be provided.

Figure 4:
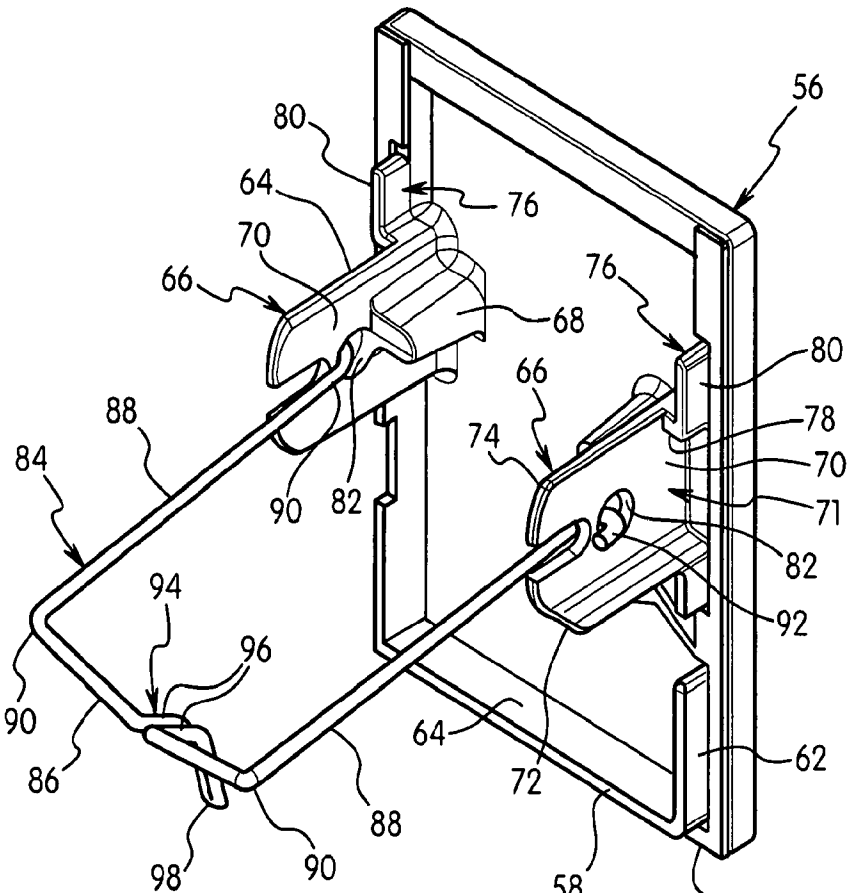
FIG. 4 is a top perspective view showing the end wall and spring clip of the invention.
Figure 8:
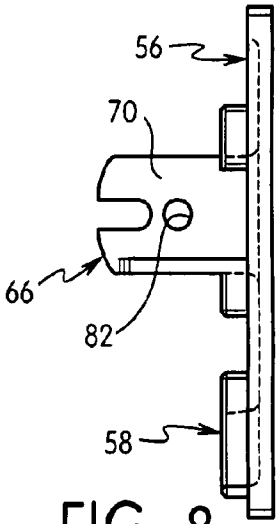
FIG. 8 is a side view of the end wall.
Figure 7:
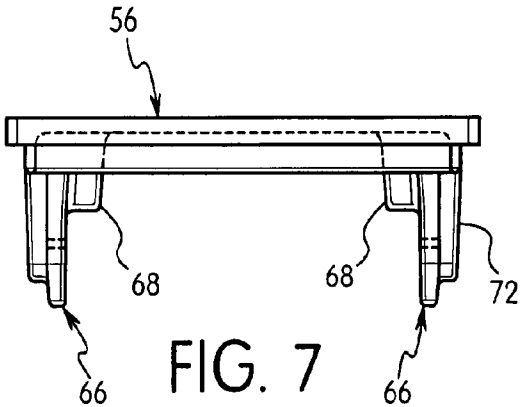
FIG. 7 is a top view of the end wall.
Figure 6:
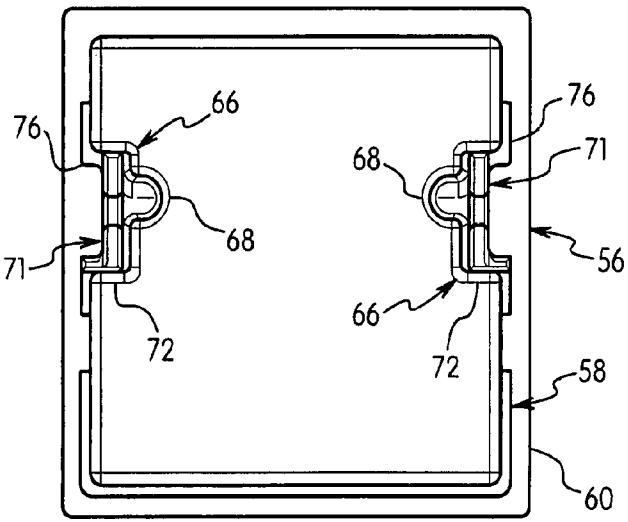
FIG. 6 is a front elevational view of the end wall.

An end wall 56 is coupled to the open longitudinal ends 24 of housing 12. Preferably, end wall 56 has an outer dimension corresponding substantially to the cross-section of housing 12 to close the end of housing 12. In the embodiment illustrated, end wall 56 has a substantially square configuration corresponding to the outer dimension of housing 12. Referring to FIG. 4, a lip 58 extends perpendicular to the plane of end wall 56 and is spaced inwardly from an outer edge 60 corresponding substantially to the thickness of side walls 20 and bottom wall 18 of housing 12. Lip 58 extends into the cavity 50 of housing 12 as shown in FIG. 3. Lip 58 includes side portion 62 to prevent lateral movement, and a bottom portion 64 to prevent downward movement of end wall 56 with respect to housing 12.

End wall 56 includes a pair of arms 66 adjacent the side edges of end wall 56. Arms 66 extend substantially perpendicular to the plane of end wall 56 and extend into cavity 26 of housing 12 as shown in FIG. 3. Arms 66 have a substantially planar configuration with a strengthening rib 68 on an inner surface.

As shown in FIGS. 3 and 4, arms 66 have a planar portion 70 spaced inwardly from lip 58 and outer edge 60 of end wall 56 a distance corresponding substantially to the position and orientation of rib 32 on the respective side wall 20 of housing 12. Each arm 66 has a bottom flange 72 extending outwardly toward outer edge 60 of end wall 56. A top edge 74 of arm 66 has an L-shaped flange member 76 having a first leg 78 extending from top edge 74 toward outer edge 60, and a second leg 80 extending parallel to outer edge 60 in a generally upward direction. As shown in FIG. 3, planar portion 70 of arm 66 has an aperture 82. The outer surface of planar portion 70 has a recessed area 71 formed by bottom flange 72 and flange members 76. Recessed area 71 has a dimension corresponding to the dimension of rib 32 so that rib 32 extends into recess area 71 when end wall 56 is fitted into the open longitudinal end of housing 12.

Figure 11:
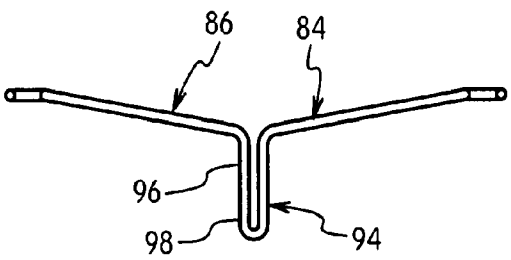
FIG. 11 is an end view of the spring clip of FIG. 8.
Figure 10:
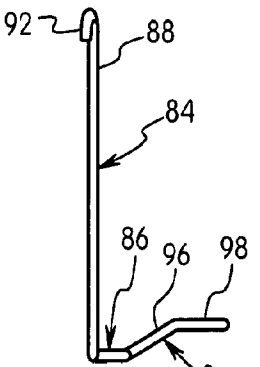
FIG. 10 is a side view of the spring clip of FIG. 8.
Figure 9:
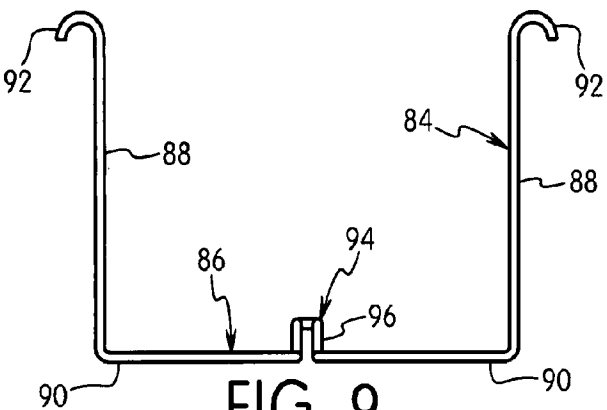
FIG. 9 is a top plan view of the spring clip in one embodiment of the invention.

End wall 56 is coupled to housing 12 by a retaining member in the form of a spring clip 84 as shown in FIGS. 1, 2 and 3. Referring to FIGS. 9-11, spring clip 84 has a substantially U-shape with a body portion 86 having legs 88 extending from opposite ends of body 86. As shown in FIG. 10, body 86 of spring clip 84 has a generally V-shape with outer ends 90. Legs 88 extend substantially perpendicular from outer ends 90 of body 86. The terminal ends of legs 88 have a bend return portion forming a hook 92. As shown in FIG. 11, the central portion of body 86 defining the apex of the V-shape has a downwardly extending hook portion 94. Hook 94 as shown in FIG. 10 has an inclined portion 96 extending from body 86. Inclined portion 96 extends in the general direction of legs 88 and diverges away from the plane of legs 88. An outer leg 98 extends from the end of inclined portion 96 and extends substantially perpendicular to body 86 and perpendicular to the plane of legs 88.

Figure 12:
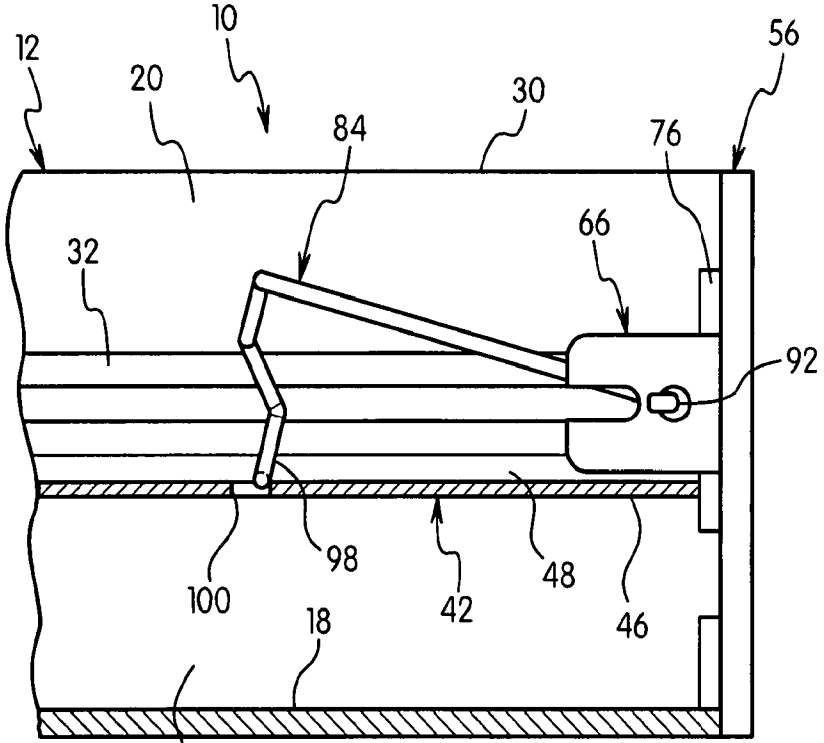
FIG. 12 is a cross-sectional side view of the housing and end wall showing the spring clip being inserted into the retaining hole.

Spring clip 84 is preferably made of spring steel, although other materials can be used. Spring clip 84 is coupled to the respective arms 66 of end wall 56 by inserting hooks 92 into the respective aperture 86 of arms 66. End wall 56 is then positioned in the open end of housing 12 with bottom flange 72 contacting bottom wall 18 of housing 12 as shown in FIG. 12. Arms 66 are positioned to overlie rib 32 with bottom flange 72 contacting a bottom edge of rib 32. Bottom flange 72 of arms 66 engage the bottom surface of rib 32 to resist upward movement of end wall 56 with respect to housing 12. L-shaped bracket 76 contacts an upper edge of rib 32 to stabilize end wall 56 and resist vertical and horizontal movement of end wall 56 with respect to housing 12.

Figure 13:
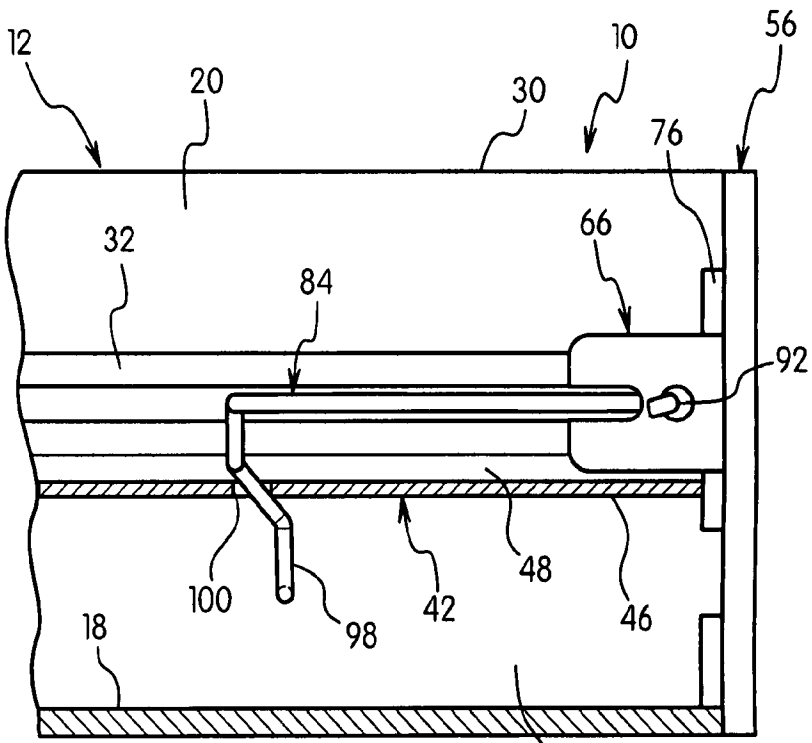
FIG. 13 is a cross-sectional side view of the housing and end wall with the spring clip inserted into the retaining hole.

Reflector 42 is provided with a hole 100 positioned for receiving hook 94 of spring clip 84 as shown in FIGS. 3, 12 and 13. Hole 100 is positioned in reflector 42 to provide sufficient tension to retain end wall 56 coupled to housing 12. As shown in FIG. 13, leg 98 of hook 94 is inserted into hole 100 in reflector 42 and pressed downwardly so that inclined portion 96 is received by hole 100 which deflects hook 94 to apply a biasing force to retain the end wall on housing 12. Hook 94 can be removed from reflector 42 by pulling upwardly to release spring clip 84, thereby allowing separation of end wall 56 for repairing or replacement of electrical components.

As shown in FIG. 2, the V-shape of body 86 of spring clip 84 enable spring clip 84 to be closely spaced to reflector 42 without interfering with lamp 14 mounted in lamp base 54.

In the embodiment illustrated, spring clip 84 has a single hook portion that is centrally located for coupling with a single centrally located hole in the reflector. In other embodiments, the body portion of the spring clip can have two or more spaced apart hook portions that can couple with corresponding holes in the reflector or in the housing. Alternatively, more than one spring can be used to couple the end wall to the housing. For example, a pair of spring clips can be used where each spring clip is coupled to opposite side edges of the end wall. Each clip can have one end coupled to a respective side edge of the end wall and a hook portion for engaging a hole in the reflector. Although the holes are shown as being provided in the reflector, the holes for receiving the hook portion of the clip can be provided in the housing along the bottom wall or side walls.

While various embodiments have been disclosed in connection with the invention, it will be understood by those skilled in the art that various changes and modifications can be made without departing from the scope of the invention as defined in the appended claims.

What is claimed is:

1. A lighting assembly comprising:

a housing having a first side wall, a second opposing side wall, a bottom surface, and an open first longitudinal end and a second longitudinal end;

a lamp base at each of said longitudinal ends for supporting a lamp within said housing and extending between said first and second longitudinal ends;

an end wall removably coupled to said open first longitudinal end of said housing; and a spring clip having a first leg coupled to said end wall, a second leg coupled to said end wall, and a hook coupled to said housing for removably coupling said end wall to said housing, said hook being positioned between said lamp and said bottom surface of said housing, and said lamp overlies said hook.

2. The lighting assembly of claim 1, wherein said housing has an open top end and a lens overlying said open top end.

3. The lighting assembly of claim 1, wherein said spring clip comprises:

a body having a first end and a second end;

said first leg extending from said first end and coupled to said end wall;

said second leg extending from said second end and coupled to said end wall; and said hook extending from said body between said first and second legs and being coupled to said housing.

4. The lighting assembly of claim 3, wherein said housing includes an aperture for receiving said hook.

5. The lighting assembly of claim 3, wherein said end wall has a bottom edge, a top edge, a first side edge having a first arm and a second side edge with a second arm, and where said first leg of said first spring clip is coupled to said first arm of said end wall and said second leg of said spring clip is coupled to said second arm of said end wall.

6. The lighting assembly of claim 5, wherein said first and second side walls have an inner surface with a longitudinal rib, and each of said first and second arms have a recess for mating with said ribs.

7. The lighting assembly of claim 6, wherein each of said arms of said end wall have an upper flange for mating with a top surface of the respective rib and a lower flange for mating with a bottom surface of said rib, said upper and lower flanges defining said recess in said arms.

8. A lighting assembly comprising:

a housing having a bottom wall, a first side wall and a second opposing side wall, said housing having an open longitudinal end;

a reflector positioned in said housing, said reflector having an aperture therein;

a lamp base for supporting a lamp within said housing;

an end wall removably coupled to said open longitudinal end; and at least one spring clip having a first leg and second leg coupled to said end wall, and having a hook projection with an inclined surface with respect to said leg received in said aperture in said reflector to apply a biasing force to retain said end wall on said housing.

9. The lighting assembly of claim 8, wherein said reflector is spaced from said bottom wall and extends between said first and second side walls, and where said aperture is centrally located relative to said housing.

10. The lighting assembly of claim 8, wherein said spring clip comprises:

a body having a first end and a second end;

said first leg extending from said first end of said body and being coupled to a first side of said end wall;

said second leg extending from said second end of said body and being coupled to a second side of said end wall; and where said hook projection extends from said body between said first and second legs, said hook projection having an inclined surface with respect to said body and received in said aperture to apply said biasing force.

11. The lighting assembly of claim 10, wherein said end wall has a first arm extending from said first side and a second arm extending from said second side, and where said first leg of said spring clip is coupled to said first arm of said end wall and said second leg of said spring clip is coupled to said second arm of said end wall.

12. The lighting assembly of claim 11, wherein said first and second side walls of said housing have an inwardly extending longitudinal rib, and where said first and second legs of said end wall mate with said first and second ribs, respectively.

13. The lighting assembly of claim 12, wherein each of said arms of said end wall have an upper flange for mating with an upper surface of a respective rib of said housing and a lower flange for mating with a lower surface of said respective rib of said housing.

14. A lighting assembly comprising:

a housing having a bottom wall, a first side wall with an inwardly extending rib, a second opposite side wall with an inwardly extending rib, and an open longitudinal end;

a reflector positioned in said housing and coupled to said first and second side walls, said reflector having an aperture;

a lamp base coupled to said reflector for receiving a lamp;

at least one end wall coupled to said open longitudinal end, said end wall having a bottom edge, a first side edge having a first arm extending perpendicular to said end wall, a second opposite side edge having a second arm extending perpendicular to said end wall; and a spring clip having a first leg and a second leg coupled to said first and second arms of said end wall, respectively, and a body portion with a spring hook member received in said aperture in said reflector.

15. The lighting assembly of claim 14, further comprising a lens overlying an open top end of said housing.

16. The lighting assembly of claim 14, wherein said first and second arms of said end wall have a longitudinal recess for receiving said ribs of the respective side wall of said housing.

17. The lighting assembly of claim 16, wherein said aperture in said reflector is centrally located.

18. The lighting assembly of claim 14, wherein said housing has a longitudinal dimension with open longitudinal ends having said end wall coupled thereto.

19. The lighting assembly of claim 1, wherein said housing further comprises:

a reflector extending between said first and second longitudinal ends, said reflector having an aperture therein for receiving said hook, and where said lamp overlies said aperture and hook to limit separation of said hook from said aperture without removing said lamp.

20. The lighting assembly of claim 1, wherein said end wall has a first arm on a first side edge and a second arm on a second side edge, and where said first leg of said spring clip is coupled to said first arm and said second leg is coupled to said second arm.

21. A lighting assembly comprising:

a housing having a first side wall, a second side wall, a bottom surface extending between said first and second side walls, and a first open longitudinal end;

an end wall removably coupled to said first open longitudinal end of said housing; and a coupling member for coupling said end wall to said housing, said coupling member having a hook end removably coupled to said housing, a first leg extending from said hook end and coupled to a first side of said end wall and a second leg extending from said hook end and coupled to a second side of said end wall.

22. The lighting assembly of claim 21, wherein said coupling member including a body having a first end and a second end, said first leg extending from said first end of said body and said second leg extending from said second end of said body.

23. The lighting assembly of claim 21, wherein said housing has a second open longitudinal end, a second removable wall coupled to said second open longitudinal end, and a second coupling member having a hook received in an aperture in said housing, a first leg extending from said hook and coupled to said end wall and a second leg extending from said hook and coupled to said end wall.

24. The lighting assembly of claim 21, wherein said housing includes an aperture receiving said hook end.

25. The lighting assembly of claim 21, wherein said housing includes a reflector having an aperture therein for receiving said hook end to couple said end wall to said housing.

* * * * *